US006123137A

United States Patent [19]

Levert

[11] Patent Number: 6,123,137

[45] Date of Patent: Sep. 26, 2000

[54] COMBINED MULTIPLE-GLAZED WINDOW AND LIGHT-CONTROL ASSEMBLY

[75] Inventor: Robert Jan Levert, Capelle a/d Ijssel, Netherlands

[73] Assignee: Hunter Douglas International N.V., Netherlands Antilles

[21] Appl. No.: 09/141,494

[22] Filed: Aug. 27, 1998

[30] Foreign Application Priority Data

Aug. 28, 1997 [EP] European Pat. Off. ..... 97202627

[51] Int. Cl.[7] ..... A47H 1/00

[52] U.S. Cl. ..... 160/107; 160/115; 160/176.1; 160/DIG. 17; 49/64

[58] Field of Search ..... 160/98, 107, 115, 160/174, 166 R, 168 R, 172, 176.1 R, 178 R, 310, 387, DIG. 17; 49/64, 92.1

[56] References Cited

U.S. PATENT DOCUMENTS

| | | | |
|---|---|---|---|
| 168,221 | 9/1875 | Bryan . | |
| 2,146,816 | 2/1939 | Grassby, Jr. . | |
| 2,155,985 | 4/1939 | Waterman . | |
| 2,209,355 | 7/1940 | Schmitz . | |
| 2,300,545 | 11/1942 | Gouch . | |
| 2,373,762 | 4/1945 | Krehbiel . | |
| 2,459,517 | 1/1949 | Gearhart | 160/115 |
| 2,570,199 | 10/1951 | Brown . | |
| 2,579,485 | 12/1951 | Ferguson et al. . | |
| 2,620,869 | 12/1952 | Friedman . | |
| 2,749,581 | 6/1956 | McCormick | 49/64 |
| 2,836,237 | 5/1958 | Hogin et al. | 160/115 |
| 2,979,127 | 4/1961 | Brown . | |
| 4,076,068 | 2/1978 | Archer et al. | 160/107 |
| 4,459,778 | 7/1984 | Ball | 160/107 X |
| 4,577,619 | 3/1986 | Howe, Jr. | 160/107 X |
| 4,588,012 | 5/1986 | Anderson | 160/107 X |
| 4,621,672 | 11/1986 | Hsu | 160/115 |

FOREIGN PATENT DOCUMENTS

| | | |
|---|---|---|
| 370205 | 3/1983 | Austria . |
| 060788 | 9/1982 | European Pat. Off. . |
| 303107 | 2/1989 | European Pat. Off. . |
| 0524388 | 1/1993 | European Pat. Off. . |
| 566524 | 10/1993 | European Pat. Off. . |
| 606543 | 7/1994 | European Pat. Off. . |
| 4117146 | 11/1992 | Germany . |
| 19632684 | 2/1998 | Germany . |
| 2-5875 | 2/1990 | Japan . |
| 2-15976 | 4/1990 | Japan . |
| 1536600 | 12/1978 | United Kingdom . |
| 2162226 | 1/1986 | United Kingdom . |
| 2169946 | 7/1986 | United Kingdom . |

OTHER PUBLICATIONS

Brochure of Warema, "Sonnenschutz mit Lichtlenkungs--Funktion" (no date).

(List continued on next page.)

*Primary Examiner*—Daniel P. Stodola
*Assistant Examiner*—Bruce A. Lev
*Attorney, Agent, or Firm*—Dorsey & Whitney LLP

[57] ABSTRACT

A double-pane window having a light-control assembly within its peripheral frame. The light-control assembly has an upper section which is adapted to redirect light entering the window through the outside pane so that the light, exiting the window through the inside pane, is reflected upwardly against a ceiling surface of the interior of a room, on the wall of which the window is mounted and a lower section which is adapted to inhibit light entering the window through the outside pane from exiting the window through the inside pane. The lower section and optionally the upper section can each comprise a plurality of laterally-extending slats which can be pivoted about their laterally-extending axes to inhibit or redirect light entering the window. If desired, the slats of the lower section can be pivoted independently of the slats of the upper section. The slats of at least the upper section preferably have a transverse cross-section with a concave surface facing upwardly. It is also advantageous that the upper surface of these slats be highly reflective, and these slats can also be perforated or partially translucent.

21 Claims, 3 Drawing Sheets

U.S. PATENT DOCUMENTS

| | | | |
|---|---|---|---|
| 4,664,169 | 5/1987 | Osaka et al. | 160/107 |
| 4,702,296 | 10/1987 | Anderson | 160/107 |
| 4,723,586 | 2/1988 | Spangenberg . | |
| 4,768,576 | 9/1988 | Anderson | 160/107 |
| 4,884,613 | 12/1989 | Komori et al. | 160/107 |
| 4,979,552 | 12/1990 | van der Zanden . | |
| 5,081,402 | 1/1992 | Koleda | 160/DIG. 17 X |
| 5,119,868 | 6/1992 | Werner | 160/115 |
| 5,205,335 | 4/1993 | Horton et al. | 160/176.1 R X |
| 5,226,466 | 7/1993 | Coddens | 160/107 |
| 5,388,000 | 2/1995 | Bartenbach . | |
| 5,391,967 | 2/1995 | Domel et al. | 160/DIG. 17 X |
| 5,414,334 | 5/1995 | Cheron | 160/DIG. 17 X |

COMBINED MULTIPLE-GLAZED WINDOW AND LIGHT-CONTROL ASSEMBLY

CROSS-REFERENCE TO RELATED APPLICATION

This application corresponds to and claims priority to European Application No. 97202627.2, filed Aug. 28, 1997. This European application is hereby incorporated by reference as though fully set forth herein.

BACKGROUND OF THE INVENTION a. Field of the Invention

This invention relates to a multiple-glazed window containing an integral assembly for controlling the amount of daylight passing though the window into a room. In particular, the invention relates to a window having a peripheral frame enclosing inside and outside glass panes that are substantially parallel and define a space between them which is preferably sealed and in which the light-control assembly is mounted.

b. Background Art

Double-pane windows containing motorized venetian blinds as light-control assemblies have been described in U.S. Pat. Nos. 4,723,586 and 4,979,552. Such windows have satisfied most light-control requirements. In addition, the mere positioning of a venetian blind within the space between two glass panes in a window has long been known to reduce heat losses by radiation through the window to an extent approaching those of windows with triple panes.

Notwithstanding this, the increased use of computer monitors in office buildings has presented additional demands on windows and their associated light-control assemblies for providing protection against the glare from sunlight, without totally eliminating daylight illumination within such buildings. Blocking such glare by closing the window blinds has often diminished the level of illumination in offices below acceptable limits, but increasing the use of artificial illumination, such as electric lighting, has also been objectionable from an environmental point of view.

Anti-glare venetian blinds have also been previously described. For example, in European patent 0,303,107, an anti-glare venetian blind is provided with slats: which are upwardly concave, which have their inner longitudinal edges (facing towards the room) as high or higher than their outer longitudinal edges (facing away from the room), which are mirrored on at least their topsides and retro-reflecting on their undersides, and the spacing and position of which are so selected that the light passes through them mostly into an angular region above the horizon. In European patent application 0,606,543, an anti-glare blind is provided with slats which are: upwardly concave, mirrored on their topsides and at least partially perforated. Although these blinds appear to be able to guide light towards the ceiling of a room and avoid glare, they are not adapted to allow some sunlight to enter the rest of a room. In this regard, it would be desirable, on sunny days, to be able to block or inhibit heat and glare from entering the rest of the room, without blocking daylight illumination entirely from the rest of the room.

BRIEF SUMMARY OF THE INVENTION

For this reason, there has been a continuing interest in eliminating glare and sunlight from lower portions of office windows while redirecting light from the upper portions of office windows within offices. It is therefore an object of this invention to provide an improved multiple-glazed window with an integral light-control assembly.

In accordance with this invention, a double-pane window is provided, containing, within a peripheral frame, a light-control assembly that includes:

i) an upper section which is adapted to redirect light entering the window through the outside pane so that the light exits the window through the inside pane; and ii) a lower section which is adapted to reduce or eliminate light entering the window through the outside pane from exiting the window through the inside pane. Preferably, the light passing through the upper section of the window can be reflected upwardly, against a ceiling surface of the interior of a room, to provide additional illumination. In the lower section of the window, sunlight and glare from the outside, which might otherwise disturb the occupants of the room, can be substantially reduced or eliminated as desired without losing altogether the benefits of daylight illumination.

Advantageously the upper and lower sections each comprise a venetian blind assembly provided with a plurality of substantially parallel laterally-extending elongate slats, the slats of at least the lower section being pivotable about their laterally-extending axes. Such an assembly allows the use of standard components from existing double-pane windows containing enclosed venetian blinds such as are disclosed in U.S. Pat. No. 4,723,586.

Desirably, the lower section of the light-control assembly is adjustable independently of the upper section. This permits the assembly to be used to optimize light control under different conditions.

The slats of at least the upper section of the light-control assembly preferably have a highly reflective upper surface for improved control of daylight which these slats redirect through the window. For the same purpose and advantageously in combination therewith, the slats of at least the upper section can be perforated or partly translucent.

Further enhancement of light distribution with the window of the invention can be obtained by giving the slats of the upper section a cross-section, as taken transversely (i.e., from the outside to the inside of the window), that includes a concave surface facing upwardly. In certain embodiments of the invention, each of the upwardly concave slats of the upper section preferably has a mirrored top surface and a retro-reflective bottom surface. In other embodiments, the upwardly concave slats of the upper section preferably have a mirrored top surface and are wholly or partially perforated.

In addition, heat losses by radiation through the window of this invention, particularly in the winter, can be further substantially reduced by providing the surface on the inside- and/or outside-facing surfaces of preferably all of the slats with an emission coefficient lower than 0.5, and preferably lower than 0.3, for radiation with a wavelength larger than 1.5 micrometer. In this regard, advantageous are aluminium slats coated with a very thin zinc chromate layer, such as are described in British patent 1,536,600.

Although each slat of the light-control assembly in accordance with this invention can be individually suspended from pivots on laterally opposite sides of the window frame, it is preferred that the slats be tiltably suspended from laterally-spaced tilt cords. In this regard, of the slats of the lower section of the light control assembly may be tiltably suspended from laterally-spaced tilt cords and the slats of the upper section be non-tiltably fixed in a position re-directing light upwardly towards the ceiling of the room.

Preferably an electric motor is used to adjust at least the slats of the lower section of the light-control assembly. A suitable electric motor is described in U.S. Pat. No. 4,979,552 and is preferably hermetically sealed in the space between the windowpanes. The use of such an electric motor is particularly advantageous when movement of the light-control assembly is to be adjusted with a microprocessor control so as to allow optimal light regulation under varying conditions without requiring the intervention of the room occupants.

In one embodiment of this invention, the top of the lower section is suspended from a laterally-extending intermediate bar, beneath the upper section. Such an arrangement allows an increased number of existing components of known double-pane windows containing venetian blinds to be used and also allows the upper and lower sections to be mounted in the window in essentially the same manner. Advantageously, the intermediate bar is suspended only at its lateral edges from laterally opposite sides of the frame, using a T-shaped connector at one lateral edge and an electric motor for the lower section as a connector at the other lateral edge.

The window of the invention is substantially vertical. Normally it will be truly vertical but it may be mounted in a slanted position in which case the plane of its light-control assembly is advantageously positioned closer to the upper glass pane of the window, as so mounted. In this regard, it is especially advantageous that the attachment of the upper and lower sections of the light-control assembly to the intermediate bar be positioned closer to the upper glass pane to compensate for any sagging of the light-control assembly within the slanted window, and it is particularly advantageous that the upper end of the upper section and the lower end of the lower section also be positioned closer to the upper glass pane to compensate for any sagging of the light-control assembly within the slanted window.

BRIEF DESCRIPTION OF THE DRAWINGS

Preferred embodiments of the sealed double-pane window with a light-control assembly of this invention will now be described in more detail with reference to the accompanying drawings in which.

DESCRIPTION OF THE PREFERRED EMBODIMENTS

Figure 1:
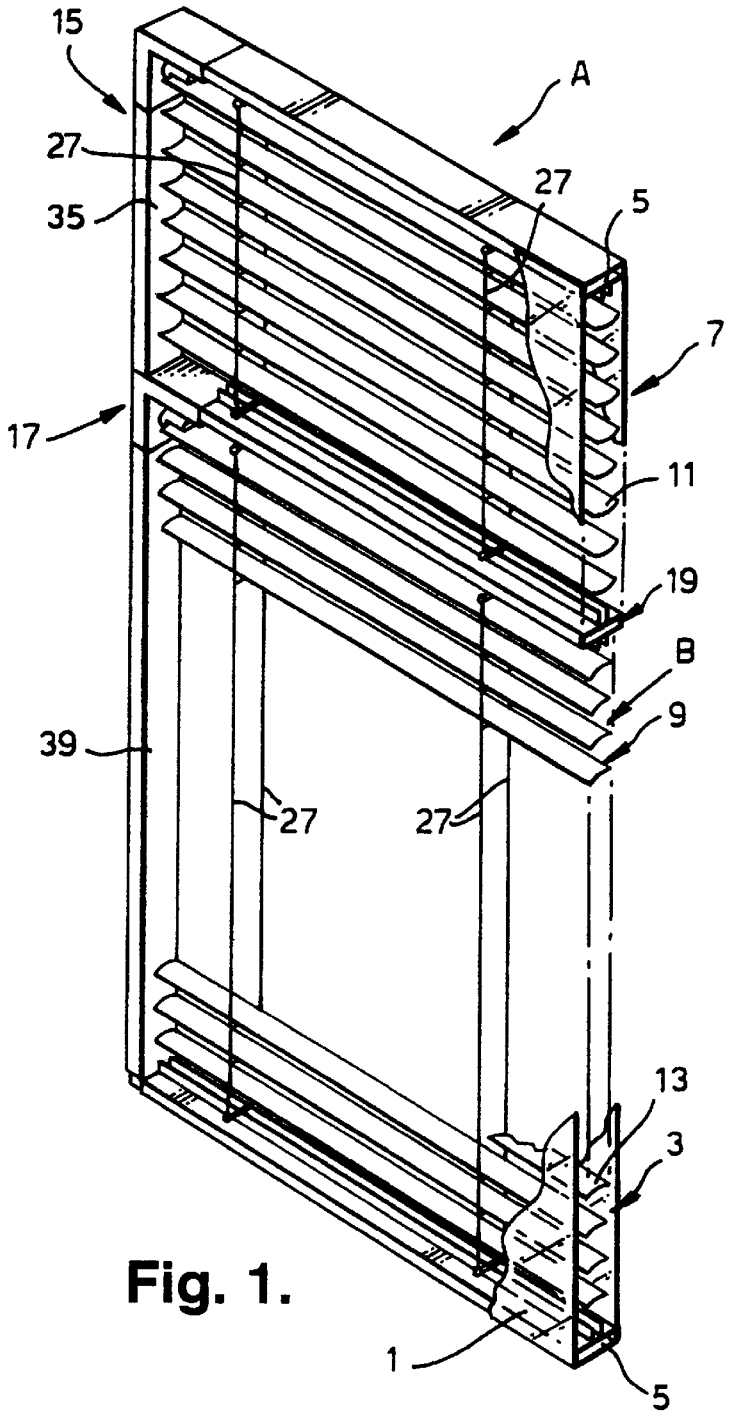
FIG. 1 is a schematic perspective view of a double-glazed window, shown partly in section, containing a light-control assembly according to the invention.
Figure 2:
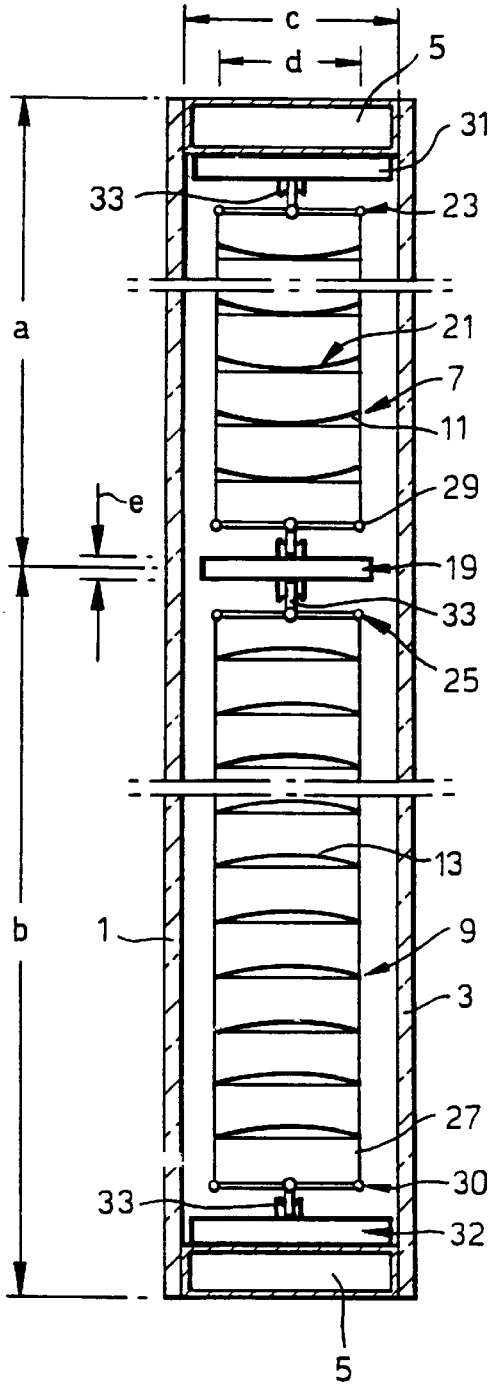
FIG. 2 is a vertical sectional view of the window of FIG. 1, showing in more detail the light-control assembly and its mounting within the window.

Schematically shown in FIGS. 1 and 2 is one embodiment of a substantially vertical, hermetically sealed, double-pane window of this invention, generally indicated by reference A. The window A is provided with a light-control assembly, generally indicated by reference B, that is mounted in the space between the two glass panes 1 and 3 of the window. The first or outside pane of glass 1 and the second or inside pane of glass 3 are positioned on opposite sides of a rectangular peripheral, plastic or metal (e.g., aluminum) frame 5 of the window A.

The glass panes 1 and 3 and the frame 5 are adhered together by a suitable sealing compound, such as is conventional in making hermetically sealed, multiple-glazed windows.

The light-control assembly B, mounted between the glass panes 1 and 3 and within the frame 5 of the window A of FIGS. 1 and 2, has an upper section 7 and a lower section 9. Each section 7 and 9 comprises an array of parallel elongate slats 11 and 13 respectively, that are substantially horizontal and laterally-extending and can be pivoted or tilted about their laterally-extending axes. In alternative embodiments of the assembly B, the slats 13 of the lower section 9 can be pivoted or tilted about their laterally-extending axes while the slats 11 of the upper section are non-tiltably fixed in a position allowing the light to be guided towards the ceiling. Preferably, the upper section 7 occupies less of the area of the window A than does the lower section 9.

The slats 11 and 13 each have a curved cross-section when viewed parallel to the panes of the window A. The slats 11 in the upper section 7 have their concave surfaces facing generally upwardly, and the slats 13 in the lower section 9 have their convex surfaces facing generally upwardly. Each section 7 and 9 of the light-control assembly B is provided with its own motor drive 15 and 17, respectively, for tilting its slats. Of course, if the slats 11 of the upper section 7 are non-tiltably installed in the window, its motor drive 15 can be omitted.

The first motor 15 for tilting the slats 11 of the upper section 7 is mounted in the peripheral frame 5 as described in U.S. Pat. No. 4,979,552.

The second motor 17 for tilting the slats 13 of the lower section 9 is connected to a lateral edge of a substantially horizontal laterally-extending elongate intermediate bar 19 which separates the upper section 7 from the lower section 9 of the light-control assembly B of the double-pane window A.

The use of separate motors 15 and 17, together with a suitable control for activating the motors individually, permits the slats 11 and 13 of the upper and lower sections to be tilted separately and independently. The use of a microprocessor as a control for the motors would permit the slats of the light-control assembly B to pivot automatically in response to changing light conditions in the room(s), in the walls of which the window is mounted, or in response to other parameters, such as time.

As a result of this arrangement, daylight can be reflected from the outside by the slats 11 of the upper section 7 of the window A on to a ceiling surface of a room to compensate for the light blocked out, for glare protection, by the slats 13 of the lower section 9 of the window.

A suitable proportion of light protection and light redirection can be obtained for many windows of office buildings and the like if the upper section 7 extends over roughly one-third of the height of the window A as indicated by "a" in FIG. 2 and the lower section 9 extends over roughly two-thirds thereof as indicated by "b" in FIG. 2.

Figure 1A:
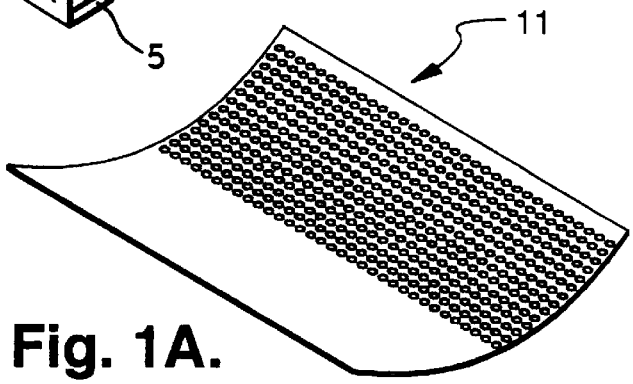
FIG. 1A is an enlarged view of a length of a slat from the upper section according to one alternative embodiment

The light distribution effects of the upper section 7 of the light-control assembly B can be further improved by positioning its slats 11 with their upwardly concave surfaces 21 facing generally vertically upward and additionally by providing these concave surfaces 21, with highly reflective properties. In this regard, top surfaces of these slats can be mirrored as described in EP 0,303,107. The bottom surfaces of these slats 11 can likewise be provided with retro-reflective properties as described in EP 0,303,107 or instead, the slats 11 can be wholly or partially perforated as described in EP 0,606,543 and shown in FIG. 1A.

As seen in FIG. 2, the upper ends of both the upper and lower blind sections 7 and 9 of the light-control assembly B of this invention are pivotally suspended from respective transversely-extending tilt bars 23 and 25 by means of parallel ladder strings 27, the upper ends of which are attached to the transverse edges of the tilt bars. The lower end of each blind section 7 and 9 carries a transversely-extending terminal slat 29 and 30 respectively, which preferably is identical to the upper tilt bars 23 and 25. The lower ends of the parallel ladder strings 27 are attached to the transverse edges of the terminal slats 29 and 30. The upper tilt bar 23 and the lower terminal slat 30 are pivotally connected to conventional, horizontal, upper and lower carriers or glass spacers 31 and 32 respectively, which are mounted within the frame 5, on its top and bottom respectively. The lower tilt bar 25 and the upper terminal slat 29 are pivotally connected to the bottom and top of the intermediate bar 19.

The tilt bars 23 and 25 and terminal slats 29 and 30 can be pivotally connected to their respective spacers 31 and 32 and intermediate bar 19 in a conventional manner. Preferably, these elements are connected in the manner described in U.S. Pat. No. 4,723,586, using detent grooves (not shown) in the top and bottom of the spacers 31 and 32 and the intermediate bar 19 and using hanger pivots 33 mounted in the grooves and pivotally connected to the respective tilt bars and terminal slats.

The transverse spacing "c" in FIG. 2 between the panes of glass 1 and 3 is a function of the thickness of the peripheral frame 5, including its spacers 31 and 32. The transverse spacing "c" must accommodate the transverse thickness "d" of the blind slats 11 and 13 and the transverse thickness of the spacers 31 and 32 as shown in FIG. 2. In sealed glass blind units as described in U.S. Pat. No. 4,979,552, it is not uncommon for such spacers to have a transverse width of only about 22 millimetres and for the blind slats to have a transverse width of only about 12 to 16 millimetres.

With such reduced dimensions of the slats 11 and 13 in accordance with this invention, as compared to the dimensions of conventional venetian blinds, the intermediate bar 19 should be as unobtrusive as possible, and its height "e" as shown in FIG. 2 should be about the same as the vertical spacing between adjacent slats 11 and 13. At the same time, the intermediate bar 19 should be sturdy enough to carry the weight of the bottom section 9 of the light control assembly B.

If desired, the transverse edges of the intermediate bar 19 can be mounted on the opposed inner surfaces of the glass panes 1 and 3 in a manner similar to that used for mounting the spacers 31 and 32 on the frame 5. The sealing compound used to bond and seal the frame 5 and glass panes 1 and 3 together could also be used for this purpose. However, it is possible that the intermediate bar 19 to be free of attachment to the inner surfaces of the glass panes 1 and 3, and, in particular, for the intermediate bar 19 to be free-floating relative to the panes 1 and 3. Alternatively, the intermediate bar 19 could be suspended from the terminal slat 29 of the upper section 7 of the light control assembly B, and if desired, the motor 17 for driving the slats 13 of the lower section 9 could also be free-hanging with the intermediate bar 19 within the window A of this invention.

Figure 3:
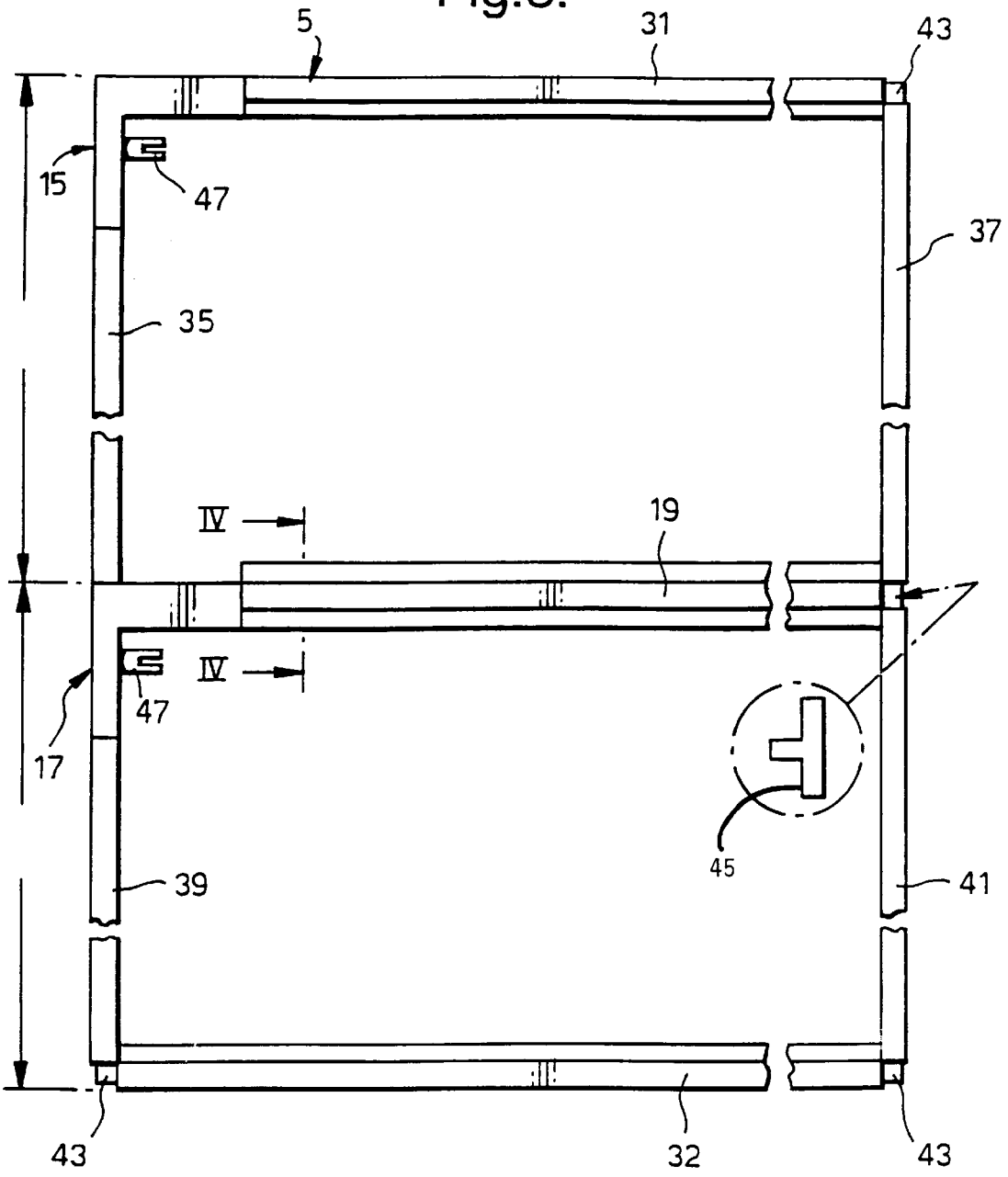
FIG. 3 is a front elevation view showing an assembled peripheral frame for the window of FIG. 2 prior to fitting the light-control assembly within the frame.

However, it is preferred to suspend the intermediate bar 19, as shown schematically in FIG. 3, from laterally opposite sides of the frame 5 so as not to put too much strain on the ladder cords 27 or tilt cords (not shown) or on the supporting components of the upper section 7 of the light control assembly B. To this end, laterally opposite sides of the frame 5 are provided with vertical frame members 35, 37, 39 and 41, two of the frame members 35 and 37 being located above the intermediate bar 19, the other two frame members 39 and 41 being located below the intermediate bar 19, and an upper frame member 35 and a lower frame member 39 being located on opposite lateral sides of the frame from the other upper and lower frame members 37 and 41 respectively. The motor 15 for the upper section 7 of the light-control assembly B is connected to both the upper spacer 31 and the top of the left upper vertical frame member 35, thereby forming the left upper corner of the frame. The other motor 17 for the lower section 9 of the light-control assembly B is connected to the bottom of the left upper vertical frame member 35, as well as to the top of the lower left vertical frame member 39. The remaining three corners of the frame are connected by L-shaped corner connectors 43.

The intermediate bar 19 is connected to the right upper and lower frame members 37 and 41 by a T-shaped connector 45 which is separately shown to an enlarged scale in an insert to FIG. 3. The T-shaped connector is adapted to be inserted into the bottom of the upper frame member 37, into the top of the lower frame member 41 and into a lateral side of the intermediate bar 19.

As shown in FIG. 3, the motors 15 and 1 7 each have a laterally-protruding, slotted shaft 47. Each of these shafts 47 is adapted to engage a lateral edge of one of the tilt bars 23 and 25 of the upper and lower sections 7 and 9 of the light-control assembly B of the window A of this invention as shown in FIG. 2. As described in U.S. Pat. No. 4,979,552, electrical conduits (not shown) pass through the frame, preferably in a sealed manner, and are connected to the motors 15 and 1 7 to power them.

Figure 4:
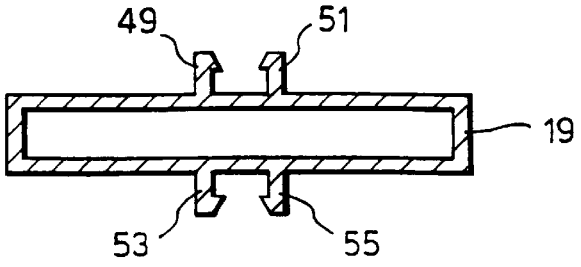
FIG. 4 is a transverse cross-sectional view, taken along line IV—IV in FIG. 3, showing one embodiment of the intermediate bar of the light-control assembly.

A cross-section of the intermediate bar 19 is shown in FIG. 4. Upwardly extending, hanger attachment flanges 49 and 51 define an undercut detent groove between them on the upper side of the intermediate bar 19. Similar detent grooves are also provided between the downwardly extending, hanger attachment flanges 53 and 55 on the lower side of the intermediate bar 19. The pivot hangers 33, such as are described in U.S. Pat. No. 4,723,586, are engaged in such grooves and are connected to the tilt bars 23 and 25 and the terminal slats 29 and 30.

If a double-pane window A as shown in FIGS. 1–4 were to be mounted in an inclined position, as is sometimes required from an architectural point of view, there would be a tendency for its slats 11 and 13 to hang against the lower pane of glass.

Figure 5:
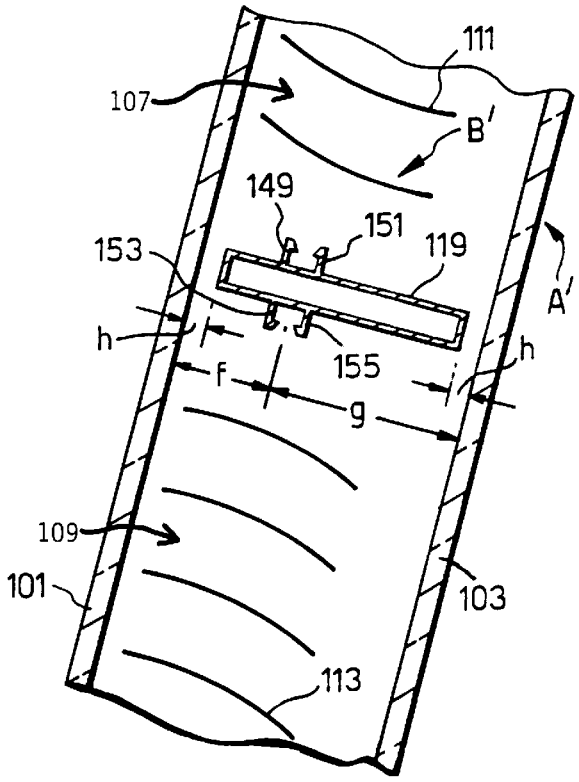
FIG. 5 is partial vertical cross-sectional view, of an alternative embodiment of the window of the invention.

Such an arrangement is shown in FIG. 5.

In the following description, corresponding parts of the alternative embodiment of the invention shown in FIG. 5 are referred to by reference numerals which differ by "100" from those of the embodiment shown in FIGS. 1–4.

FIG. 5 shows an inclined sealed double-pane window, generally A', with a light-control assembly B' of this invention having a modified intermediate bar 119.

In the window A' of FIG. 5, the tendency for the slats 111 and 113 to sag and, as a result, to hang against the lower pane 103 of glass is compensated for by displacing the hanger attachment flanges 149, 151, 153 and 155 on the top and bottom of the intermediate bar 119 toward the upper pane 101. This results in there being unequal distances "f" and "g" in FIG. 5 between i) the pivot points of the blind sections 107 and 109 with the intermediate bar 119 and ii) the panes 101 and 103. Preferably, the hangers (not shown in FIG. 5) on the tilt bar (also not shown in FIG. 5) at the upper end of the upper section 107 and on the terminal slat (also not shown in FIG. 5) at the lower end of the lower section 109 also are mounted on their respective upper and lower spacers closer to the upper glass pane 101 to compensate further for any sagging of the light-control assembly B' within the slanted window A'.However, the transverse spacing "h" in FIG. 5 of the intermediate bar 119 from the upper and lower panes 101 and 103 is preferably kept equal, so that the intermediate bar can be connected to the vertical frame members (not shown) in the same manner as is described in relation to FIG. 3.

This invention is, of course, not limited to the above-described embodiments of FIGS. 1–5, which may be modified without departing from the scope of the invention or sacrificing all of its advantages. In this regard, the terms in the foregoing description, such as "left", "right", "lateral", "bottom", "top", "transverse", "upper" and "lower", have been used only as relative terms to describe the relationships of the various elements of the combined multiple-glazed window and light-control assembly of the invention.

What is claimed is:

1. A double-pane window comprising a peripheral frame;

parallel outside and inside panes of glass mounted to said peripheral frame in spaced relation to each other; and a light-control assembly mounted between said panes, said light-control assembly including a horizontally extending intermediate bar dividing said light-control assembly into an upper section and a lower section;

a first adjustment means for adjusting said upper section; and a second adjustment means for adjusting said lower section, whereby said lower section is adjustable independently of said upper section.

2. The double-pane window of claim 1, wherein said upper section comprises a first plurality of parallel, laterally-extending slats, and wherein said lower section comprises a second plurality of parallel, laterally-extending slats.

3. The double-pane window of claim 2, wherein each slat in said first plurality of slats has an upwardly-concave cross section, and further wherein each slat in said second plurality of slats has a downwardly-concave cross section.

4. The double-pane window of claim 3, wherein said second plurality of slats are interconnected to simultaneously pivot about their laterally-extending axes to redirect light entering said lower section.

5. The double-pane window of claim 4, wherein said first plurality of slats are interconnected to simultaneously pivot about their laterally-extending axes to redirect light entering said upper section, and further wherein said first plurality of slats are pivotable independently of said second plurality of slats.

6. The double-pane window of claim 2 or 5, further comprising upper and lower transversely-extending tilt bars, each having lateral edges and transverse edges, wherein said upper tilt bar is at a top of said upper section and said lower tilt bar is at a top of said lower section, and wherein said first adjustment means comprises a first motor, said first motor engaging one of said lateral edges of said upper tilt bar, and said second adjustment means comprises a second motor, said second motor engaging one of said lateral edges of said lower tilt bar;

a first pair of parallel ladder cords connected to said transverse edges of said upper tilt bar and extending therebelow, said first plurality of slats being mounted to said first pair of parallel ladder cords, whereby said first plurality of slats are pivoted by activating said first motor; and a second pair of parallel ladder cords connected to said transverse edges of said lower tilt bar and extending therebelow, said second plurality of slats being mounted to said second pair of parallel ladder cords, whereby said second plurality of slats are pivoted by activating said second motor.

7. The double-pane window of claim 6, wherein each of said motors is controlled by a microprocessor so that the slats of each section can be pivoted automatically to change the light passing through the window in response to at least one of changing light conditions and time.

8. The double-pane window of claims 4, wherein each of said first plurality of slats comprises a highly-reflective, upper surface.

9. The double-pane window of claim 4, wherein only said first plurality of slats are partially translucent.

10. The double-pane window of claim 9, wherein said first plurality of slats are perforated.

11. The double-pane window of claim 4, wherein at least one side of each slat in said first and second pluralities of slats has a surface with an emission coefficient lower than 0.5 for radiation with a wavelength larger than 1.5 micrometer.

12. The double-pane window of claim 11, wherein each of said surfaces has an emission coefficient lower than 0.3 for radiation with a wavelength larger than 1.5 micrometer.

13. The double-pane window of claim 1, wherein said lower section is suspended from said intermediate bar.

14. The double-pane window of claim 13, wherein said upper section has a top and a bottom, and wherein said lower section has a top and a bottom, and further wherein said bottom of said upper section and said top of said lower section are each pivotally connected to said intermediate bar.

15. The double-pane window of claim 13, wherein said peripheral frame has a top side, a bottom side, and lateral sides extending between said top and bottom sides, and wherein said intermediate bar has first and second lateral edges that are connected to opposite lateral sides of said frame.

16. The double-pane window of claim 15, wherein a motor, mounted in said frame, connects said first lateral edge of said intermediate bar to said frame.

17. The double-pane window of claim 16, wherein a T-shaped connector, mounted in said frame, connects said second lateral edge of said intermediate bar to said frame.

18. The double-pane window of claim 13, wherein the window is inclined so that one of said outside and inside panes is positioned at an orientation above the other, and wherein said upper and lower sections of said light-control assembly are attached to said intermediate bar at a location closer to said one, above-positioned pane than to said other pane.

19. The double-pane window of claim 18, wherein said upper and lower sections of said light-control assembly are attached to said top and bottom of said frame at locations closer to said one, above-positioned pane than to said other pane.

20. An inclined, double-pane window comprising a peripheral frame, substantially parallel spaced apart outside and inside panes of glass mounted to said frame, a light-control assembly mounted between said panes to control light passing through the window, said light-control assembly including:

i) an upper section effective to redirect the light entering the window through said outside pane, whereby the light exits the window through said inside pane;

ii) a lower section effective to inhibit the light entering the window through said outside pane from exiting the window through said inside pane; and iii) a substantially horizontal, laterally-extending elongate intermediate bar, said lower section being suspended from said intermediate bar, wherein one of said outside and inside panes is positioned at an orientation above the other, and wherein said upper and lower sections of the light-control assembly are attached to said intermediate bar at a location closer to said one, above-positioned pane than to said other pane.

21. The window as claimed in claim 20, wherein said peripheral frame has at top side and a bottom side, and wherein the upper and lower sections of the light-control assembly are attached to the top and bottom sides of the frame at locations closer to said one, above-positioned pane than to said other pane.

* * * * *